United States Patent [19]

Lehnen

[11] 4,421,358

[45] Dec. 20, 1983

[54] ARM REST CONSTRUCTION

[76] Inventor: James A. Lehnen, 84 Roosevelt Ave., Waterloo, Ontario, Canada

[21] Appl. No.: 191,525

[22] Filed: Sep. 29, 1980

Related U.S. Application Data

[63] Continuation-in-part of Ser. No. 35,513, May 3, 1979, Pat. No. 4,252,371.

[51] Int. Cl.[3] ..... A47C 504; A47C 7/12; A47C 7/54

[52] U.S. Cl. ..... 297/421; 297/27; 297/28; 297/78; 297/359

[58] Field of Search ..... 297/421, 417, 27, 28, 297/78, 31, 39, 46, 355, 330, 418, 359

[56] References Cited

U.S. PATENT DOCUMENTS

| | | | |
|---|---|---|---|
| Re. 30,648 | 6/1981 | Ohlrogge et al. | 297/421 X |
| 64,535 | 5/1867 | Hyde | 297/27 |
| 107,581 | 9/1870 | Wilson | 297/27 |
| 532.676 | 1/1895 | Lovejoy | 297/27 |
| 2,778,407 | 1/1957 | Schweizer | 297/27 |
| 3,037,811 | 6/1962 | Vanderminden | 297/39 X |
| 3,047,334 | 7/1962 | Vanderminden | 297/39 |
| 4,241,950 | 12/1980 | Simpson | 297/39 X |

FOREIGN PATENT DOCUMENTS

| | | | |
|---|---|---|---|
| 202308 | 8/1958 | Austria | 297/57 |
| 1941803 | 3/1977 | Fed. Rep. of Germany | 297/27 |

*Primary Examiner*—James T. McCall
*Attorney, Agent, or Firm*—Sim & McBurney

[57] ABSTRACT

There is provided an arm rest assembly for a chair or the like, including an arm rest member and a support member which are pivoted together. The arm rest member has a top surface and the support member terminates below the top surface and is pivoted thereto at a location slightly rearwardly of the forward end. These members define an angle which changes as the chair is adjusted, and the arm rest member includes stop means forwardly of the support member and below the top surface, the stop means being adapted to come into contact with the support member when the angle enlarges to a predetermined size less than 180°. This prevents the arm rest and support members from reaching a dead center position, and avoids the risk that the user's finger will become trapped between the support member and the forward end of the arm rest member.

5 Claims, 8 Drawing Figures

ARM REST CONSTRUCTION

This is a continuation-in-part of U.S. patent application Ser. No. 35,513, filed on May 3, 1979, and entitled "Lounge Chair" now U.S. Pat. No. 4,252,371.

This invention relates generally to patio furniture construction, and has to do particularly with an arm structure for lounge chairs.

BACKGROUND OF THIS INVENTION

Many patio or lounge chairs are presently marketed which consist of a back portion and a seat portion, these two portions being hingedly connected together in such a way that the back portion can assume any of a number of discrete angulated positions with respect to the horizontal. A particular form of hinging arrangement used in many conventional lounge chair constructions incorporates within the hinge itself a mechanism by which the back portion can be set to any of a number of discrete angles and will support the weight of the user while at that angle. The disclosure of the principal application Ser. No. 35,513 is concerned not with the hinge per se, but with the possibility of providing an arm rest structure on such a lounge chair, constructed so that arm members extending from the back portion will always remain horizontal or substantially so, regardless of the angle of angle of inclination of the back portion.

In any arm rest assembly for a lounge chair or similar structure (such as that set forth in the principal application Ser. No. 35,513), whenever the arm rest assembly is provided in the form an approximate parallelogram, there is always the possibility that, when the back part of the lounge chair or the like swings all the way backwardly to lie approximately parallel with the main part of the chair, the arm rest assembly can go through a dead center position, and become "locked" in that position so that it cannot be brought forwardly and upwardly again. In addition to this risk, depending upon the actual construction of the arm rest assembly, there can be a danger that the user's fingers will become trapped or snagged under the arm rest member, as and when the arm rest assembly approaches or goes through the dead center position. This risk will become clearer below, based on the discussion with reference to the drawings of this application.

GENERAL DESCRIPTION OF THIS INVENTION

It is therefore a general aspect of this invention to provide an arm rest assembly for a lounge chair or the like in which the structure is such that the arm rest member and the member supporting it are prevented from reaching or going through a dead center position, thereby avoiding the risk that the user's fingers will become trapped in the arm rest assembly.

Accordingly, this invention provides an arm rest assembly for a chair or the like, comprising an arm rest member having a top surface and forward and rearward ends, a support member terminating below said top surface and pivoted to said arm rest member at a location rearwardly of said forward end, the arm rest member and the support member defining an angle which changes as the said chair or the like is adjusted, and stop means forming part of the arm rest member forwardly of said location and below said top surface, said stop means coming into contact with said support member when said angle enlarges to a predetermined size less than 180°, thereby preventing the arm rest and support members from reaching a dead center position, and avoiding risk that the user's fingers will become trapped between the support member and the forward end of the arm rest member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figures 1, 2, 3:
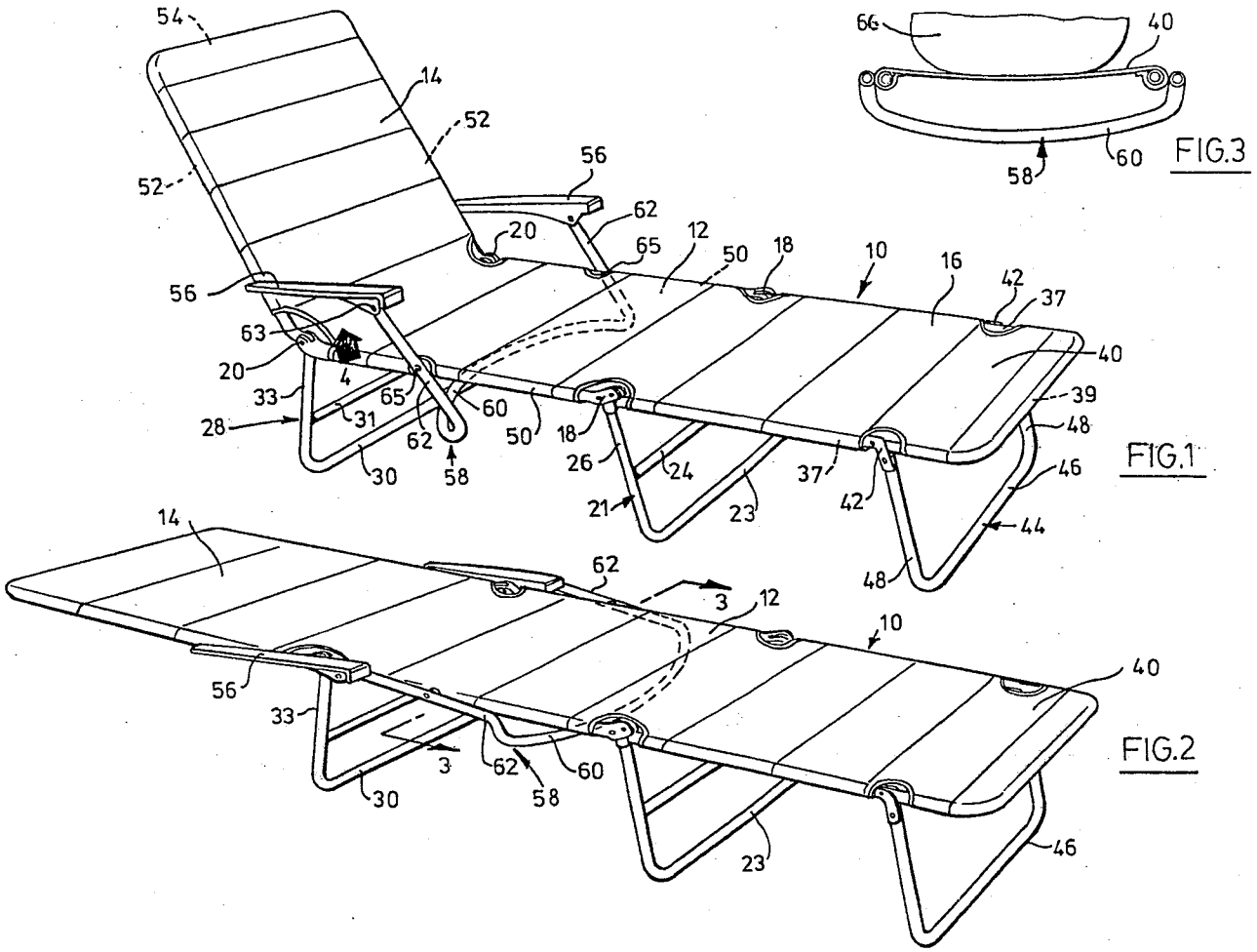
FIG. 1 is a perspective view of a lounge chair embodying the invention, with the back in angulated position.
FIG. 2 is a perspective view of the lounge chair of FIG. 1, with the back in horizontal position.
FIG. 3 is a sectional view taken at the line 3—3 in FIG. 2.

Attention is first directed to FIG. 1, which shows a lounge chair at 10, which includes a seat portion 12, a back portion 14, and a foot portion 16. The seat portion 12 is pivotally hinged to the foot portion 16 at forward hinges 18, and is pivotally hinged to the back portion 14 at rearward hinges 20. The hinges 18 and 20 are well known conventional hinges, and at least the rearward hinges 20 incorporate an internal feature by which the back portion 14 can be set into any one of a plurality of angulated positions with respect to the seat portion 12, such that it will remain in the selected position and support the weight of the user.

Extending downwardly from the forward hinges 18 is a forward ground support 21 which includes a bottom horizontal rail 23, an intermediate horizontal rail 24 and two side rails 26 (only one visible in FIG. 1).

Extending downwardly from the rearward hinges 20 is a rearward ground support 28 which includes a bottom horizontal rail 30, an intermediate horizontal rail 31 and two side rails 33 (only one visible in FIG. 1).

The foot portion of the lounge chair is defined by parallel bars 37 extending forwardly from the forward hinges 18, and a front bar 30 spanning between the parallel bars 37. In construction, the front bar 39 and the parallel bars 37 would be integral. In FIG. 1, the parallel bars 37, except for small portions thereof, are not visible due to being covered by a web-like material 40 which is strung between the bars 37. The front bar 39 is also covered by the material 40.

Spaced slightly inwardly from the front bar 39 are two hinge members 42 to which a front ground support 44 is connected. As can be seen in FIG. 1, the front ground support includes a bottom rail 46 and two side rails 48 extending upwardly from the ends of the bottom rail 46, the latter being horizontal. In construction, all parts of the front ground support would be integral.

The seat portion 12 of the lounge chair 10 is defined laterally by two parallel side bars 50, both of which are hidden except for small parts thereof by the webbing 40, which continues through the seat portion 12.

The back portion 14 is also defined by two side bars 52 and a top bar 54 which in actual construction would be integral with the side bars 52. The webbing 40 continues up the back portion 14 and hides most of the side bars 52 and all of the top bar 54 from sight in FIG. 1.

Also visible in FIG. 1 are two arm rest members 56, each of which is pivoted at its rear end to the side edges of the back portion 14 at locations substantially equally distant from the bottom edge of the back portion. A U-shaped support 58 is provided, and includes a base member 60 extending between two parallel side members 62. The tops of the side members (i.e. the ends remote from the base member 60) are pivoted to the arm rest member 56 at locations 63 spaced forwardly from the back portion 14. The side members 62 are further pivoted to the seat portion 12 at locations 65 intermediate the ends of the side members 62. By virtue of this construction, the base member 60 is located under the seat portion 12. It is essential to this construction that the U-shaped support 58 be disposed in such a way that its base member 60 remains clear of the ground at all times, and in any angular attitude of the U-shaped support 58.

It can be seen in FIGS. 1 and 2 that the side members 62, the arm rest members 56, the seat portion 12 and the back portion 14 define substantially a parallelegram linkage, in which the side members 62 are substantially parallel with the back portion 14, and in which the arm rest members 56 are substantially parallel with the seat portion 12. This will mean that the arm rest members 56 remain substantially parallel with the seat portion 12, i.e. substantially horizontal, regardless of the angular position of the back portion 14.

As can be seen in FIGS. 1, 2 and 3, the base member 60 of the U-shaped support 58 is curved toward the rear when the side members 62 are in a relatively upright position, and is curved toward the bottom (i.e. concave upwardly) when the side members 62 are relatively flat or horizontal. The concave upwardly curve of the base member 60 allows for some depression of the seat portion 12 due to the weight of the user of the lounge chair. It can be seen in FIG. 3 that the curve of the base member 60 keeps it appreciably below the level of the webbing 40 as depressed by the body 66 of the user of the lounge chair.

Figure 4:
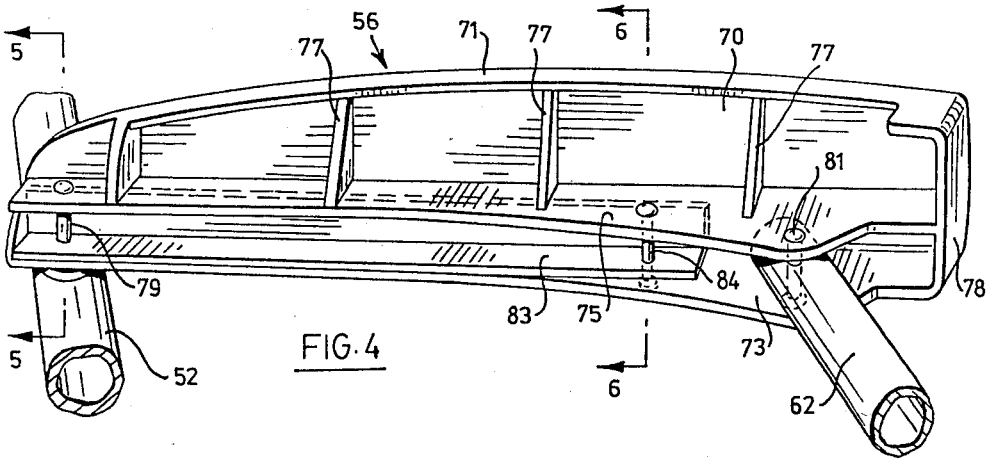
FIG. 4 is a view of one arm rest from underneath at the arrow marked by the number 4 in FIG. 1.

Attention is now directed to FIG. 4, for a detailed description of the construction of the arm rest members 56.

As can be seen in FIG. 4, which is a view from underneath, each arm rest member 56 includes a top wall 70, an outside wall 71, an inside wall 73, and an intermediate wall 75. Bridge supports 77 are provided at intervals between the outside wall 71 and the intermediate wall 75. A forward wall 78 joins the outside and inside walls 71 and 73, and has the intermediate wall 75 abutting thereagainst.

Shown at the left in FIG. 4 is a portion of the side bar 52 of the back portion 14, and shown at the right is the upper end of the respective side members 62 of the U-shaped support.

As can be seen in FIG. 4, a pin or rivet member 79 passing through the intermediate and inside walls 75 and 73 constitutes a pivot axis for the arm rest member 56 about the side bar 52. The upper end of the side member 62 extends between the walls 73 and 75, and is pivoted thereto by means of a pin or rivet member 81.

Extending longitudinally of the arm rest 56 between the walls 73 and 75 is a metal reinforcement beam 83, of L-shaped cross section, which is secured in place by the rivet 79 and by a further rivet 84 extending between the walls 73 and 75.

Figure 5:
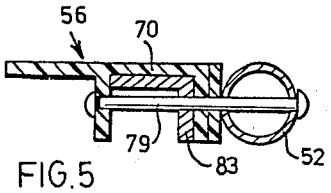
FIG. 5 is a sectional view taken at the line 5—5 in FIG. 4.
Figure 6:
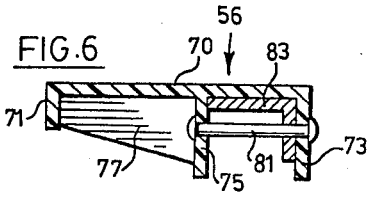
FIG. 6 is a sectional view taken at the line 6—6 in FIG. 4.

FIGS. 5 and 6 illustrates the sections through the rivets 79 and 81, respectively.

Figure 7:
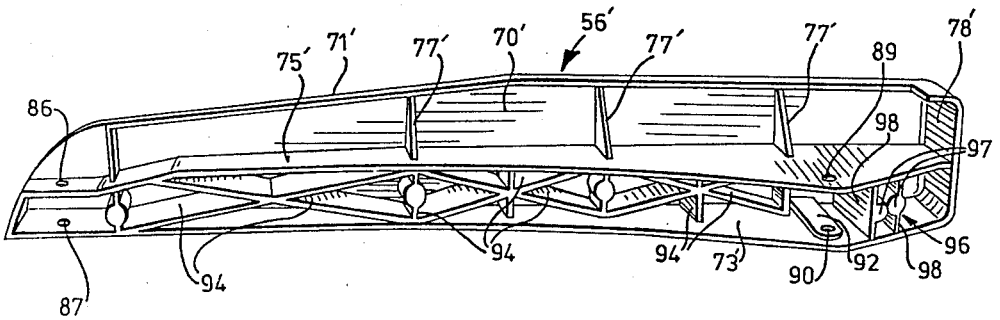
FIG. 7 is a view of a variant arm rest construction taken from underneath.
Figure 8:
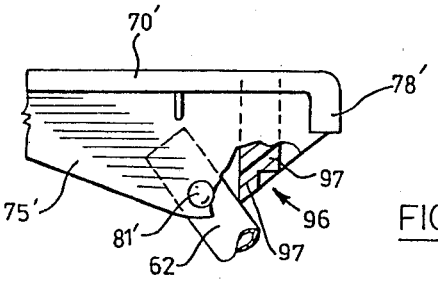
FIG. 8 is a partial elevation view of the front end of the arm rest construction of FIG. 7.

Attention is now directed to FIGS. 7 and 8, showing a variant of the arm rest construction.

In FIG. 7, the arm rest member 56' is similar to the arm rest member 56 shown in FIG. 4, except that the metal reinforcement beam 83 in FIG. 4 is absent in FIG. 7. In order to provide the requisite strength for the arm rest member 56' shown in FIG. 7, an integral structure is moulded in a manner which is easily seen in FIG. 7. The arm rest member 56' is preferably a moulded plastic item, and includes a top wall 70', an outside wall 71', an inside wall 73', and an intermediate wall 75'. Bridge supports 77' are provided at intervals between the outside wall 71' and the intermediate wall 75'. A forward wall 78' joins the outside and inside walls 71' and 73', and had the intermediate wall 75' abutting thereagainst.

At the lefthand or rear portion of the arm rest member 70', two aligned apertures 86 and 87 are located in the intermediate wall 75' and the inside wall 73', respectively. The aligned apertures 86 and 87 are adapted to receive a rivet similar to the rivet 79 shown in FIG. 4, the purpose of the rivet being to pivot the arm rest member 56' to the respective side bar 52 of the back portion 14 (see FIG. 1 for these numerals).

Toward the forward or rightward end of the arm rest member 56' in FIG. 7, the intermediate wall 75' and the inner wall 73' again have two aligned apertures 89 and 90, the purpose of which is to receive a second rivet similar to the rivet 81 seen in FIG. 4. The purpose of the rivet 81 is to pivot the member 56' to the end of side bar member 62, which constitutes a support member. The upper end extends between the walls 73' and 75'. In FIG. 7, the inner wall 73' is thickened integrally at 92 for increased strength.

Extending in the general region between the apertures 86, 87 and the apertures 89, 90, and between the intermediate wall 75' and the inner wall 73', are integral reinforcing webs 94, provided in crossing or star-like formations. The webs have a greater dimension in a vertical plane, and a smaller dimension in a transverse or horizontal plane (imagining that the arm rest member 56' is oriented with its top wall 70' horizontal).

Immediately forwardly (rightwardly) of the apentures 89, 90 in FIG. 7 is located an integral stop means 96, which extends downwardly from the top wall 70' to a location such that, when the arm rest member 56' is pivoted to the respective side member 62, little if any room is left between the side member 62 and the guard structure 96 for the fingers of the user to be entrapped. As is best seen in FIG. 7, the stop means 96 includes two parallel contacting and integral ribs 97, each of which is integral with a protective wall 98. The plate member 98 extend between the intermediate wall 75' and the inner wall 73'.

Due to the protective walls 98, the stop means 96 is relatively resilient, such that, as the back portion 14 of the lounge chair is pivoted from the FIG. 1 position to the FIG. 2 position, any mechanical interference between the side member 62 and the guard structure 96 will not cause breakage or rupture of any of the parts, because the guard structure 96 is able to resiliently distort out of the way of the pivoting side member 62.

As can be seen in FIG. 8, the protective wall associated with the more rearward of the integral ribs 97 tapers toward its location of contact with the support member (side member) 62, in order to increase the resilience at the contacting portion.

Further, it will be understood that the provision of the stop means 96 will not allow the obtuse angle between the arm rest member 56 and the support member (side member) 62 to exceed a certain predetermined angle (approximately that shown in FIG. 8). This construction will effectively prevent the arm member 56 and support member 62 from reaching a dead center position or going through this dead center position. If they should go through the dead center position, further adjustment of the louge chair or the like would be extremely difficult or impossible. Any attempt to force the lounge chair to change its position could, if the arm rest assembly had gone through its dead center position, cause damage to that assembly. Furthermore, it will be clear from FIG. 8 that the presence of the stop means 96 will prevent the assembly from attaining a position in which the user's fingers become trapped between the support member 62 and the forward wall 78.

I claim:

1. In a lounge chair construction having a seat portion and a back portion hinged together along a common edge, each said portion having sides substantially normal to said common edge, an arm rest member pivoted at its rearward end to a side edge of the back portion and pivoted near its forward end to a support member which in turn is pivoted to the corresponding side edge of the seat portion; the arm rest member, the support member and parts of the said side edges of the seat and back portions defining an approximate parallelogram:

the provision of a forward overhang on the arm rest member whereby the forward extremity projects forwardly from the location at which the arm rest member is pivoted to the support member, said location being under a top surface of the arm rest member, the support member terminating under said top surface, and a protective wall forming part of the arm rest member and positioned forwardly of said location below said top surface; such that, as the arm rest member moves rearwardly with the back portion, thus causing the angle which it defines with the support member to become larger, the said protective wall can come into contact with the support member below the said location whereby to prevent the arm rest member and support member from reaching a position in which the user's fingers become trapped between the support member and the forward part of the arm rest member.

2. An arm rest assembly for a chair or the like, comprising an arm rest member having a top surface and forward and rearward ends, a support member terminating below said top surface and pivoted to said arm rest member at a location rearwardly of said forward end, the arm rest member and the support member defining an angle which changes as the said chair or the like is adjusted, and stop means forming part of the arm rest member forwardly of said location and below said top surface, said stop means coming into contact with said support member when said angle enlarges to a predetermined size less than 180° thereby preventing the arm rest and support members from reaching a position in which the user's fingers become trapped between the support member and the forward end of the arm rest member.

3. The assembly claimed in claim 2, in which the stop means and the arm rest member are integrally formed of plastic material, and in which the stop means includes a protective wall which tapers toward the portion thereof which contacts the support member, whereby to increase the resilience at said contacting portion.

4. The assembly claimed in claim 3, in which said protective wall is substantially normal to the said top surface of the arm rest member.

5. The assembly claimed in claim 3, in which said stop means includes a double wall.

* * * * *